United States Patent [19]

Winkelmann et al.

[11] Patent Number: 4,709,905

[45] Date of Patent: Dec. 1, 1987

[54] CASING ASSEMBLY FOR INJECTING MATERIAL INTO A METALLURGICAL VESSEL

[75] Inventors: Manfred Winkelmann, Krefeld; Udo Muschner, Tönisvorst, both of Fed. Rep. of Germany; Pierre Gerber, Hausen, Switzerland

[73] Assignee: Didier-Werke AG, Wiesbaden, Fed. Rep. of Germany

[21] Appl. No.: 857,538

[22] Filed: Apr. 30, 1986

[30] Foreign Application Priority Data

Jun. 5, 1985 [DE] Fed. Rep. of Germany ..... 3520207

[51] Int. Cl.[4] ..... C21C 5/48

[52] U.S. Cl. ..... 266/270; 266/282; 266/283; 266/286

[58] Field of Search ..... 266/220, 265, 270, 280, 266/282, 283, 286

[56] References Cited

U.S. PATENT DOCUMENTS 2,947,527 8/1960 Spire ..... 266/220

FOREIGN PATENT DOCUMENTS 3206499 8/1983 Fed. Rep. of Germany .

15404 8/1966 Japan ..... 266/282

*Primary Examiner*—L. Dewayne Rutledge

*Assistant Examiner*—Robert L. McDowell

*Attorney, Agent, or Firm*—Wenderoth, Lind & Ponack

[57] ABSTRACT

A casing assembly includes a nozzle brick to form part of a wall of a metallurgical vessel. The nozzle brick has therethrough a conical opening defined by a conical inner surface. A casing to be inserted into the conical opening has a truncated conical shape including a conical outer surface and an axially extending flow through opening. The conical opening and the casing have coaxial center axes, and the conical inner and outer surfaces extend at equal angles of inclination to such axes. The conical inner surface is jacketed with a thin metal shell having a conical shape with the same inclination as that of the conical inner and outer surfaces.

9 Claims, 1 Drawing Figure

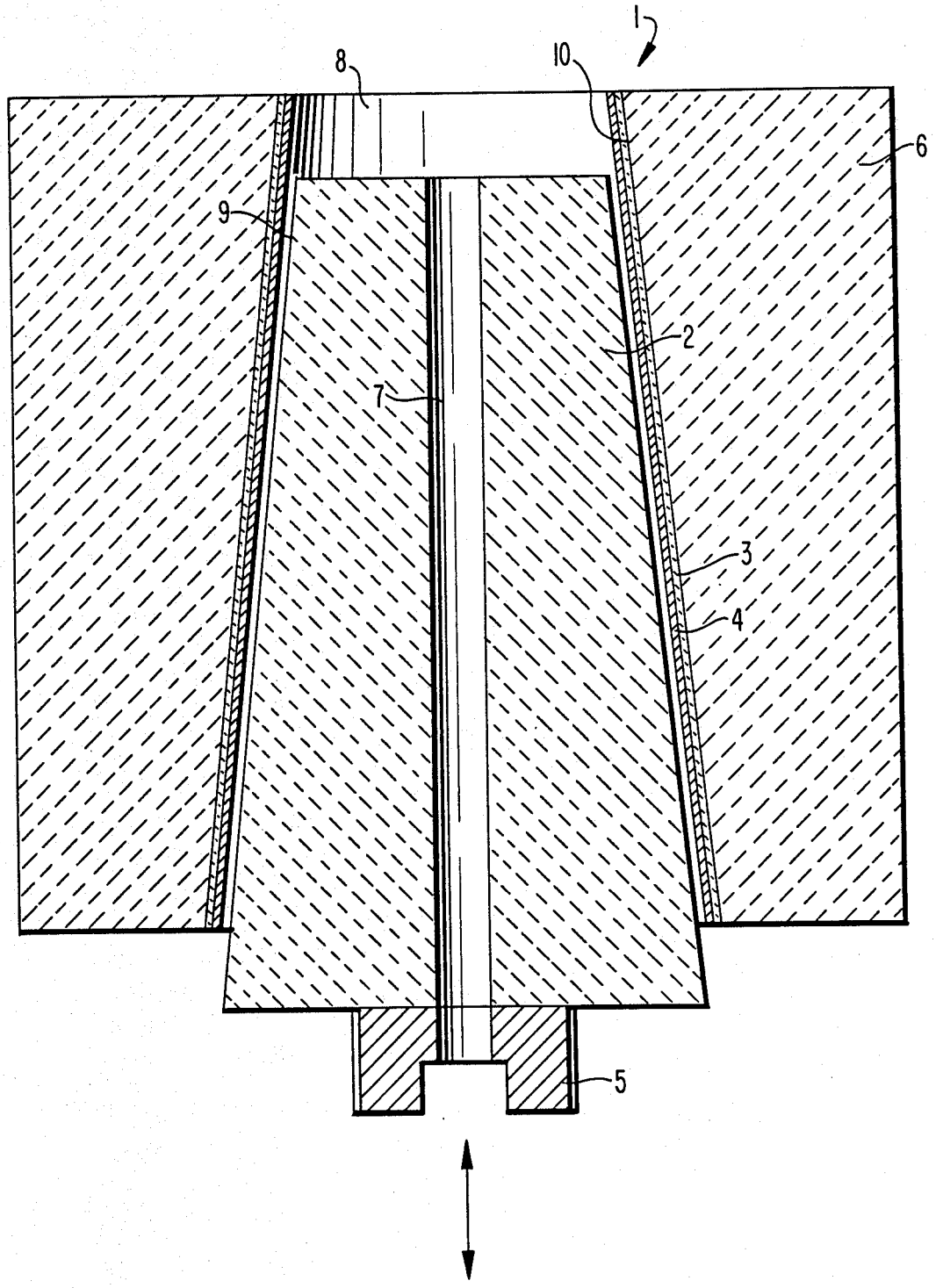
1
8
10
6
9
2
7
3
4
5

CASING ASSEMBLY FOR INJECTING MATERIAL INTO A METALLURGICAL VESSEL

BACKGROUND OF THE INVENTION

The present invention relates to a housing or casing assembly particularly for use in blowing or injecting gases or solids into a metallurgical vessel, particularly a ladle, containing molten material, particularly in the vicinity of a sliding closure unit. The present invention particularly is directed to such an assembly having a casing essentially shaped like a truncated cone and provided with a flow through conduit, the casing to be inserted into a conical opening in a nozzle brick forming a portion of the wall of the metallurgical vessel.

In known casing assemblies of this type, the casing is set into the conical opening of the nozzle brick by means of mortar. This arrangement however results in substantial expenses for material and loss of production time of the metallurgical vessel. Moreover, when a worn casing must be replaced, the conical opening of the nozzle brick must be cleaned, and this is a difficult and time consuming operation, substantially due to the great influence of heat. Furthermore, setting of the casing with mortar in this known manner results in an imprecise seat of the casing in the conical opening.

SUMMARY OF THE INVENTION

Accordingly, it is an object of the present invention to provide a casing assembly of this general type by which it is possible to overcome the above and other prior art disadvantages.

It is a further object of the present invention to provide such a casing assembly whereby the casing may be set and replaced more rapidly than is possible with prior art assemblies.

It is a yet further object of the present invention to provide such a casing assembly which achieves a very precise seat of the casing in the conical opening in the nozzle brick.

These objects are achieved in accordance with the present invention by the provisions that the conical inner surface defining the conical opening in the nozzle brick and a conical outer surface of the casing have equal degrees of conicity, i.e. the conical surfaces extend at equal angles of inclination to coaxial respective center axes, and that the conical inner surface is jacketed with a thin metal, for example iron, shell having a conical shape with the same inclination as the conical inner and outer surfaces. The inclination preferably is 5°, with the result that there is a wedging action achieved upon insertion of the casing into the conical opening, thereby resulting substantially in a self-locking seat of the casing within the conical opening. Since the casing is not seated within the conical opening by mortar, as in the case in the prior art, it is possible to provide for rapid and clean replacement of the casing, even with the elements in a relatively hot state, while providing a precise seat. This may be achieved with great safety and only slight cleaning costs, compared to the prior art.

The concept of the present invention is applicable not only to casing assemblies used specifically for injecting gases or solids into a metallurgical vessel, but to other similar casing assemblies, for example for sliding closure units, wherein a casing element previously was set in position only with mortar.

The selection of the inclination of the conical inner surface of the conical opening and of the conical outer surface of the casing is achieved in a manner to provide for a wedging or automatic locking of the casing within the conical opening. The jacketing of the conical inner surface of the nozzle brick with a metal shell guarantees a precise seat of the casing within the conical opening, whereby normal tolerance deviations of the nozzle brick are compensated. Thus, the metal shell can be formed to closer manufacturing tolerances than can the conical opening in the nozzle brick. In order to replace a used casing, the worn casing merely need be withdrawn from the nozzle brick and a new casing set in its place. Since cleaning operations substantially are eliminated, considerable time and work is saved. The shortening of the replacement time increases the availability of the metallurgical vessel for production, and this results in the casing assembly of the present invention being even more economical than if consideration is given just to savings of material and time for setting and replacing of the casing. The advantages gained by the present invention particularly are evident in basic lined ladles, but also are apparent in other types of ladle and other metallurgical vessel linings.

A fixed and solid connection of the metal shell to the nozzle brick can be guaranteed in accordance with a further feature of the present invention, wherein the metal shell is permanently fixed to the conical inner surface by a mortar having a relatively low sintering temperature. Thus, for example, during operation the nozzle brick, the metal shell and the casing may be subjected to temperatures between approximately 1550° C. and 800°-900° C. maximum. To ensure that, during removal of the casing from the nozzle brick opening, the metal shell remains connected with the nozzle brick, a mortar is employed having a sintering temperature of approximately 600°-700° C. maximum. As a result, the sintering temperature of the mortar is well below the lower limit operating temperature.

In accordance with a further feature of the present invention the metal shell has a thickness of from 0.6 to 1.0 mm, preferably approximately 0.8 mm. This ensures an extraordinarily precise seat of the casing, with compensation of normal tolerance deviations of the nozzle brick. Any tolerance differences between the nozzle brick and the metal shell are compensated by the intervening mortar layer. The tolerance of the thickness of the metal shell is approximately 0.1 mm. The tolerances of the dimensions of the conical inner surface of the nozzle brick and the conical outer surface of the casing are approximately 0.5 mm, such tolerances providing a substantially 100% precise seat of the casing.

In order to make it easier to remove the casing from the nozzle brick, in accordance with a further feature of the present invention, the conical outer surface of the casing is coated with a mixture of water glass and graphite.

In accordance with yet a further feature of the present invention, the outer axial end of the casing is provided with means, such as an adaptor, to make it easier to remove the casing from the conical opening.

BRIEF DESCRIPTION OF THE DRAWING

Other objects, features, advantages and uses of the present invention will be apparent from the following detailed description of a preferred embodiment, given by way of example and without limitation, with reference to the accompanying drawing, wherein:

The single FIGURE is a vertical section of a casing assembly in accordance with one embodiment of the present invention.

DETAILED DESCRIPTION OF THE INVENTION

The casing assembly 1 shown in the drawing includes a perforated nozzle brick 6 which, in a known manner, forms a portion of a wall of a metallurgical vessel, for example a ladle containing molten metal. Nozzle brick 6 has therethrough a conical opening 8 defined by a conical inner surface 10. A sleeve, housing or casing 2 is to be inserted into conical opening 10 and has a truncated conical shape including a conical outer surface 9 and an axially extending flow through opening 7. The materials of brick 6 and casing 2 are intended to be conventional and would be understood by one of ordinary skill in the art.

Conical inner and outer surfaces 10, 9 are formed with identical conical configurations or degrees of conicity. That is, surfaces 10, 9 extend at equal angles of inclination to coaxial center axes of the respective elements. Conical inner surface 10 is jacketed with a thin metal, for example iron, shell 4 having a small thickness and the same inclination as the conical inner and outer surfaces 10, 9. This degree of conicity or inclination of surfaces 10, 9 and of metal shell 4 preferably is exactly or substantially 5°.

As a result, casing 2 is insertable into conical opening 8 such that conical outer surface 9 seats precisely and snugly on metal shell 4, and this particularly can be achieved with a wedging action resulting essentially in a self-locking seat.

Iron shell 4 is fixed to conical inner surface 10 by a layer of mortar 3 with a low sintering temperature, thereby ensuring that when casing 2 is removed from conical opening 8 the metal shell 4 will remain attached to the nozzle brick 6.

The outer axial end of casing 2 is provided with an adaptor 5 for cooperation with a removal device for removing casing 2 from conical opening 8. In the illustrated embodiment, adaptor 5 is positioned concentrically to flow through opening 7 and provides a continuation thereof. Insertion and removal of casing 2 is achieved in the directions indicated by the double arrow in the drawing. To facilitate removal of the casing 2, the conical outer surface 9 may be coated with a mixture of water glass and graphite.

Trials have shown that the normal replacement time for replacing casing 2 can be reduced with the assembly arrangement of the present invention from the previously required time of approximately 30 minutes to 10 minutes, a time saving of 200%. Furthermore, the practical safety of the casing arrangement of the present invention has been corroborated. No infiltration of steel was detected during a trial with a 270 ton ladle.

Although the present invention has been described and illustrated with respect to preferred features thereof, it is to be understood that various modifications and changes may be made to the specifically described and illustrated arrangements without departing from the scope of the present invention.

We claim:

1. A casing assembly, for use with a metallurgical vessel containing molten material, said casing assembly comprising:

a nozzle brick adapted to form part of a wall of a metallurgical vessel, said nozzle brick having therethrough a conical opening defined by a conical inner surface;

a casing to be inserted into said conical opening and having a truncated conical shape including a conical outer surface;

said conical opening and said casing having coaxial center axes, and said conical inner and outer surfaces extending at equal angles of inclination to said axes; and said conical inner surface being jacketed with a thin metal shell having a conical shape with the same inclination as said conical inner and outer surfaces;

whereby said casing is insertable into said conical opening such that said conical outer surface seats precisely and snugly on said metal shell.

2. An assembly as claimed in claim 1, wherein said inclination of said inner and outer surfaces and of said metal shell is 5°.

3. An assembly as claimed in claim 1, wherein said metal shell is fixed to said conical inner surface by a mortar having a relatively low sintering temperature.

4. An assembly as claimed in claim 1, wherein the thickness of said metal shell is from 0.6 to 1.0 mm.

5. An assembly as claimed in claim 4, wherein said thickness is approximately 0.8 mm.

6. An assembly as claimed in claim 4, wherein the tolerance of said thickness is approximately 0.1 mm.

7. An assembly as claimed in claim 1, wherein the tolerances of said conical inner and outer surfaces are approximately 0.5 mm.

8. An assembly as claimed in claim 1, wherein said conical outer surface is coated with a mixture of water glass and graphite.

9. An assembly as claimed in claim 1, further comprising means on the outer axial end of said casing for removing said casing from said conical opening.

* * * * *